US009732533B2

(12) United States Patent
Ruzhin

(10) Patent No.: US 9,732,533 B2
(45) Date of Patent: Aug. 15, 2017

(54) CONSTRUCTION PROTECTION SHEET

(71) Applicant: Victor Ruzhin, Kenmore, WA (US)

(72) Inventor: Victor Ruzhin, Kenmore, WA (US)

(73) Assignee: Protecboard LLC, Kenmore, WA (US)

( * ) Notice: Subject to any disclaimer, the term of this patent is extended or adjusted under 35 U.S.C. 154(b) by 0 days.

(21) Appl. No.: 15/136,760

(22) Filed: Apr. 22, 2016

(65) Prior Publication Data

US 2016/0312484 A1 Oct. 27, 2016

Related U.S. Application Data

(60) Provisional application No. 62/152,664, filed on Apr. 24, 2015.

(51) Int. Cl.
*E04B 1/00* (2006.01)
*E04G 21/30* (2006.01)

(52) U.S. Cl.
CPC ..... *E04G 21/30* (2013.01)

(58) Field of Classification Search
CPC ..... E04G 21/24
USPC ..... 52/741.3, 211, 506.05
See application file for complete search history.

(56) References Cited

U.S. PATENT DOCUMENTS 5,203,130 A * 4/1993 Freelove ..... E06B 1/30 52/211
7,228,668 B2 * 6/2007 Gibney ..... E04G 21/30 428/40.1
8,590,161 B1 * 11/2013 Huddleston ..... A62C 13/78 169/51
9,091,073 B2 * 7/2015 Wells ..... E04G 21/30
9,365,385 B2 * 6/2016 Muxlow ..... B65H 45/12
2002/0071924 A1 * 6/2002 Lopez-Valverde ..... A47G 27/0206 428/40.1
2008/0086952 A1 * 4/2008 Holwick ..... E04G 21/30 52/3
2008/0196315 A1 * 8/2008 Brisbois ..... B65D 81/053 49/462
2013/0146205 A1 * 6/2013 Blackwell ..... A47B 96/18 156/60

* cited by examiner

*Primary Examiner* — Basil Katcheves
(74) *Attorney, Agent, or Firm* — Christensen O'Connor Johnson Kindness PLLC

(57) ABSTRACT

A stair protection device includes a protection sheet having a first riser protection portion, a tread protection portion, and a second riser protection portion. The protection sheet also has at least one slit in the tread protection portion, a first score in the protection sheet between the first riser protection portion and the tread protection portion, and a second score in the protection sheet between the second riser protection portion and the tread protection portion. The protection sheet can be secured to a stair by adhering tape on a top of the tread protection portion over the at least one slit such that at least a portion of the tape passes through the at least one slit and adheres to a tread of the stair.

13 Claims, 18 Drawing Sheets

CONSTRUCTION PROTECTION SHEET

CROSS-REFERENCE TO RELATED APPLICATION

This application claims the benefit of U.S. Provisional Application No. 62/152664, filed Apr. 24, 2015, the disclosure of which is incorporated by reference it its entirety herein.

BACKGROUND

Many projects in structures, such as homes, pose dangers to finished surfaces. Such projects include remodeling, moving, replacing appliances, and others. For example, a kitchen remodel may pose dangers to surfaces in the kitchen, such as floors, countertops, and the like. Damage can occur from workers walking on the surfaces, from tools hitting the surfaces, from spills on the surfaces (e.g., paint), from equipment (e.g., a moving hand truck), and from any number of other potential dangers. Protecting surfaces during such projects is desirable to limit the cost of and amount of time to complete the projects.

SUMMARY OF THE DISCLOSURE

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a stair protection device includes a protection sheet having a first riser protection portion, a tread protection portion, and a second riser protection portion. The stair protection device includes at least one slit in the tread protection portion, a first score in the protection sheet between the first riser protection portion and the tread protection portion, and a second score in the protection sheet between the second riser protection portion and the tread protection portion. The protection sheet is configured to be secured on a stair with the tread protection portion on a tread of the stair, the first riser protection portion on a riser of the stair, and the second riser protection portion on a riser of a subsequent stair, by adhering tape on a top of the tread protection portion over the at least one slit such that at least a portion of the tape passes through the at least one slit and adheres to the tread of the stair.

In one example, the first riser section includes a plurality of scores. In another example, the plurality of scores is configured to be bent around a nosing of the stair such that a portion of the first riser protection portion reaches the riser of the stair. In another example, the at least one slit includes two slits and a length of each of the two slits is greater than a length of each of the two slits. In another example, the at least one slit includes one slit, and a width of the one slit is greater than a length of the one slit.

In one embodiment, a method of protecting a stair includes bending a protection sheet from an unfolded state to a folded state, where bending the protection sheet includes bending the protection sheet at a first score of the protection sheet between a first riser protection portion of the protection sheet and a tread protection portion of the protection sheet and bending the protection sheet at a second score between a second riser protection portion of the protection sheet and the tread protection portion of the protection sheet. The method also includes placing the protection sheet on a stair with the tread protection portion on a tread of the stair, the first riser protection portion on a riser of the stair, and the second riser protection portion on a riser of a subsequent stair. The method also includes securing the protection sheet to the stair by adhering tape on a top of the tread protection portion over at least one slit in the tread protection portion such that at least a portion of the tape passes through the at least one slit and adheres to the tread of the stair.

In one example, the method further includes taping sides of the tread protection portion to the tread of the stair. In another example, the method further includes taping the first riser protection portion to one or more of the riser of the stair or a second riser protection portion of a second protection sheet. In another example, the method further includes taping the second riser protection portion to one or more of the riser of the subsequent stair or a first riser protection portion of a second protection sheet. In another example, the method further includes bending a plurality of scores in the first riser section and placing at portion of the first riser section that includes at least some of the plurality of scores around a nosing of the stair.

In one embodiment, a method of protecting a surface having multiple corners includes bending a protection sheet from an unfolded state to a folded state, where bending the protection sheet includes bending the protection sheet at a first score of the protection sheet between a first portion of the protection sheet and a second portion of the protection sheet and bending the protection sheet at a second score between the second portion of the protection sheet and a third portion of the protection sheet. The method further includes placing the protection sheet on a first surface with the center portion on the surface and the third portion over a portion of a second surface. The method further includes securing the protection sheet to the surface by adhering tape on a top of the first portion over at least one slit in the first portion such that at least a portion of the tape passes through the at least one slit and adheres to the first surface.

In one example, the first surface includes a countertop and wherein the second surface includes at least one cabinet. In another example, the method further includes securing the protection sheet to another protection sheet that has been secured to the first surface.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Covering surfaces during projects reduces the risk of damage caused during the project. Surface protections have been developed to cover surfaces. For example, cardboard sheeting can be used to cover horizontal surfaces. Such cardboard sheeting is usually sold and transported to a project in rolls. The cardboard sheeting is unrolled and taped down to a planar surface (e.g., a hardwood floor). The cardboard sheeting then protects the surface while it is taped down to the surface. In another example, plastic sheeting can be used to cover surfaces (e.g., floors) or objects (e.g., furniture) during projects. Plastic sheeting can protect in a number of ways, such as protecting surfaces or objects from paint spills, potentially-harmful chemicals, and the like.

Figure 1A:
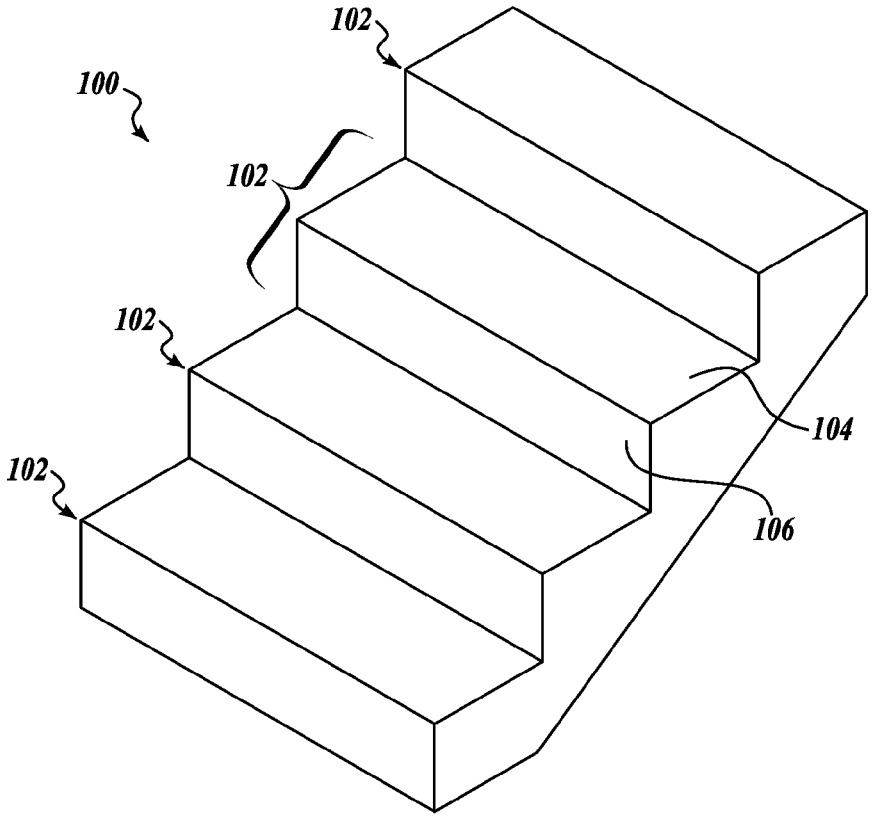
FIGS. 1A and 1B depict an example of a staircase.
Figure 1B:
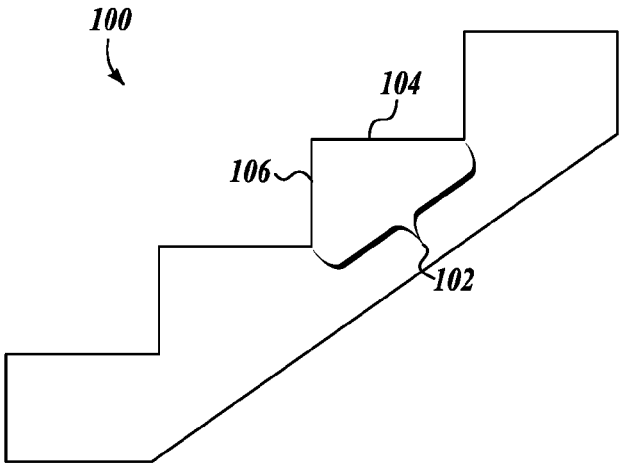

Some areas are difficult to protect using traditional materials and methods. Those areas include non-planar surfaces, such as staircases. FIGS. 1A and 1B depict an example of a staircase 100. The staircase 100 has a number of stairs 102. Each of the stairs 102 includes a tread 104 and a riser 106. The riser 106 extends upward from a previous step or floor and the tread 104 extends forward from the riser 106. In some cases, the riser 106 extends substantially vertically and the tread 104 extends substantially horizontally. People walking on the staircase 100 typically step on the tread 104 of the stairs 102 as they ascend or descend the staircase 100.

Placing effective and safe floor protection over staircases has been difficult using traditional materials and methods. Cardboard sheeting can be used as a floor protection. However, it takes a significant amount of time and effort to properly bend a single cardboard sheet to accommodate the treads and rises of the stairs in a staircase. Despite efforts to bend the cardboard sheet at the proper places and angles, the final bent cardboard sheet typically does not fit on the staircase as desired. In addition, cardboard sheeting that is sold and/or transported to a project on a roll has a tendency to curve when unrolled. This curvature increases the difficulty to properly bend the cardboard sheet and increases the chance that the cardboard sheet will move out of place after it has been placed on a staircase. Cardboard sheeting that does not properly fit on stairs can become a safety hazard as workers try to walk on the stairs to ascend or descend the staircase.

Plastic sheeting has also been used to cover stairs. Plastic sheeting can be more easily fit to the risers and treads of the stairs than cardboard sheeting. However, plastic sheeting presents a number of issues. Plastic sheeting does not always stay down flat on stairs. Any portion of the plastic sheeting that is not flat on the stairs poses a tripping hazard for workers walking on the stairs. Plastic sheeting is also typically less resilient than cardboard sheeting. Regular traffic over plastic sheeting can cause rips or tears in the plastic sheeting, leaving holes in the protection of the stairs. Rips and tears in the plastic sheeting also pose a tripping hazard for workers walking on the stairs.

Figure 2:
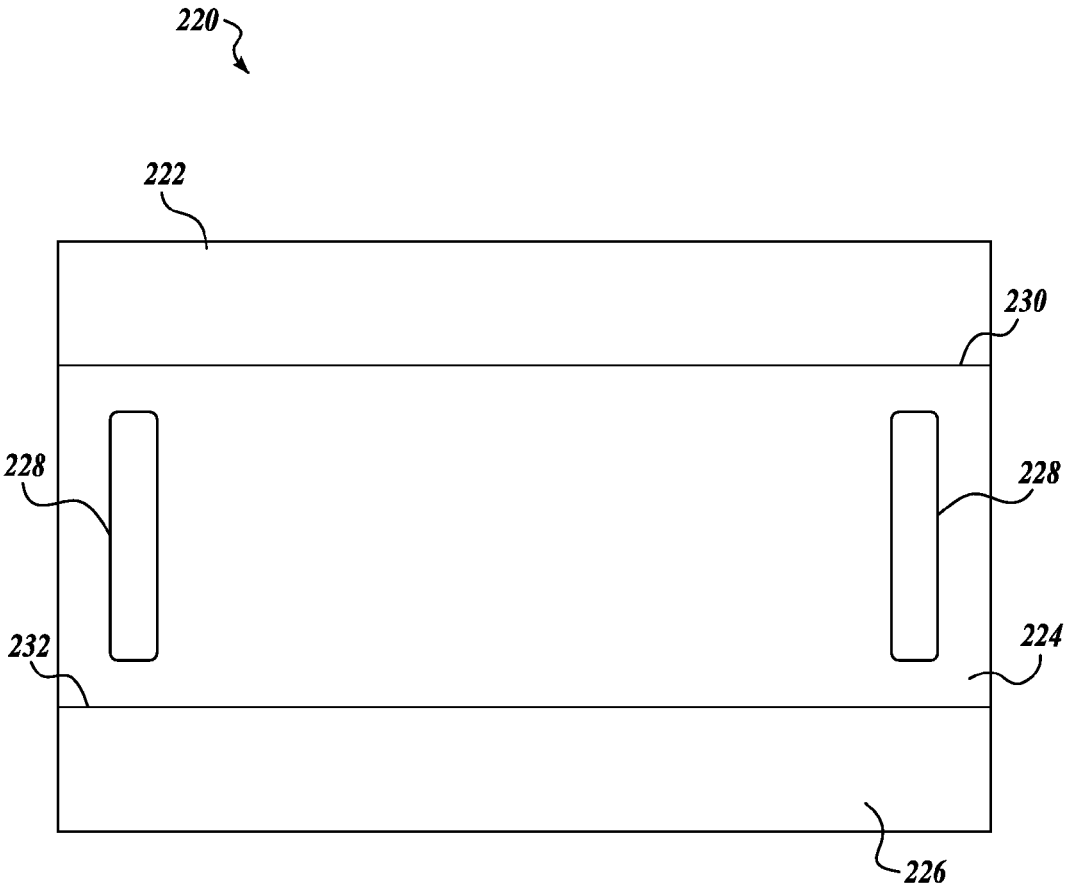
FIG. 2 depicts a top view of one embodiment of a stair protection device that can be used to protect a stair on the staircase depicted in FIGS. 1A and 1B.

The problems presented with existing surface protection can be addressed by embodiments of stair protection devices described herein. FIG. 2 depicts a top view of one embodiment of a stair protection device 220. In one embodiment, the stair protection device 220 is made of a protection sheet, such as a cardboard sheet. The stair protection device 220 includes a first riser protection portion 222, a tread protection portion 224, and a second riser protection portion 226. As described in greater detail below, the first riser protection portion 222 and the tread protection portion 224 are configured to be placed on a riser and a tread, respectively, of a stair, and the second riser protection portion 226 is configured to be placed on a rise of a subsequent stair. The tread protection portion 224 includes at least one slit 228. As described in greater detail below, the at least one slit 228 is useful in adhering the stair protection device 220 to a tread of a stair. In one embodiment, the at least one slit 228 is a hole through the tread protection portion 224.

The stair protection device 220 also includes a first score 230 and a second score 232. The first score 230 is located between the first riser protection portion 222 and the tread protection portion 224. The second score 232 is located between the second riser protection portion 226 and the tread protection portion 224. Each of the first and second scores 230 and 232 is configured to aid in bending the stair protection device 220. In one embodiment, the first score 230 is made in the top surface of the stair protection device 220 so that the first riser protection portion 222 is configured to bend downward (i.e., away from a viewer of FIG. 2). In one embodiment, the second score 232 is made in the bottom surface of the stair protection device 220 so that the second riser protection portion 226 is configured to bend upward (i.e., toward a viewer of FIG. 2).

Dimensions of the stair protection device 220 can be selected based on a size of a stair, such as an actual stair size, an expected stair size, an average stair size, and the like. In one embodiment, the length of the tread protection portion 224 (i.e., the distance from the first score 230 to the second score 232) is based on a length of a tread of a stair. In one example, the length of the tread protection portion 224 is approximately 11 inches. In another embodiment, the width of the stair protection device 220 (i.e., the distance from the top end to the bottom end of the stair protection device 220, as depicted in FIG. 2) is based on a width of a stair. In one example, the width of the stair protection device 220 is approximately 36 inches. In another embodiment, each of the at least one slit 228 has a width of about 0.5 inches and a length of about 8 inches. Various other dimensions of the stair protection device 220 and its components are possible.

FIGS. 3A to 3H depict a method of protecting stairs of a staircase 300 using stair protection devices 320 and 320'. The staircase 300 has stairs, including stair 302, stair 302', and stair 302". Stair 302 includes a tread 304 and a riser 306. Stairs 302' and 302" similarly include risers 304' and 304" and risers 306' and 306", respectively. Stair protection device 320 includes a first riser protection portion 322, a tread protection portion 324, and a second riser protection portion 326. The tread protection portion 324 includes one or more slits 328. The stair protection device 320 also includes a first score 330 located between the first riser protection portion 322 and the tread protection portion 324 and a second score 232 located between the second riser protection portion 326 and the tread protection portion 324. Stair protection device 320' similarly includes a first riser protection portion 322', a tread protection portion 324', a second riser protection portion 326', one or more slits 328', a first score 320', and a second score 322'. In one embodiment, the stair protection devices 320 and 320' are made from a cardboard sheet material, such as 45 pound cardboard sheet material.

Figure 3A:
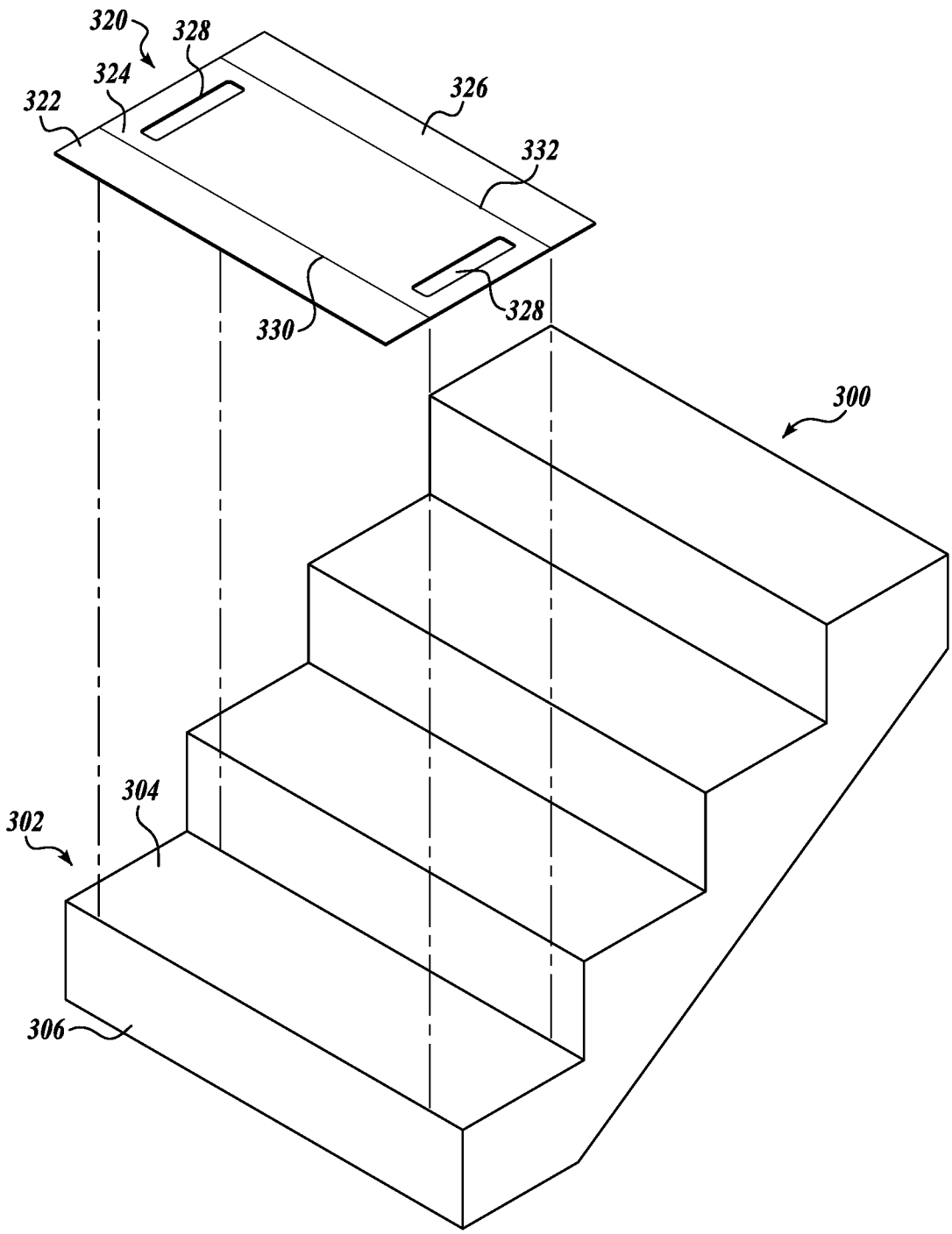
FIGS. 3A to 3H depict a method of protecting stairs of a staircase using stair protection devices, in accordance with the embodiments described herein.
Figure 3B:
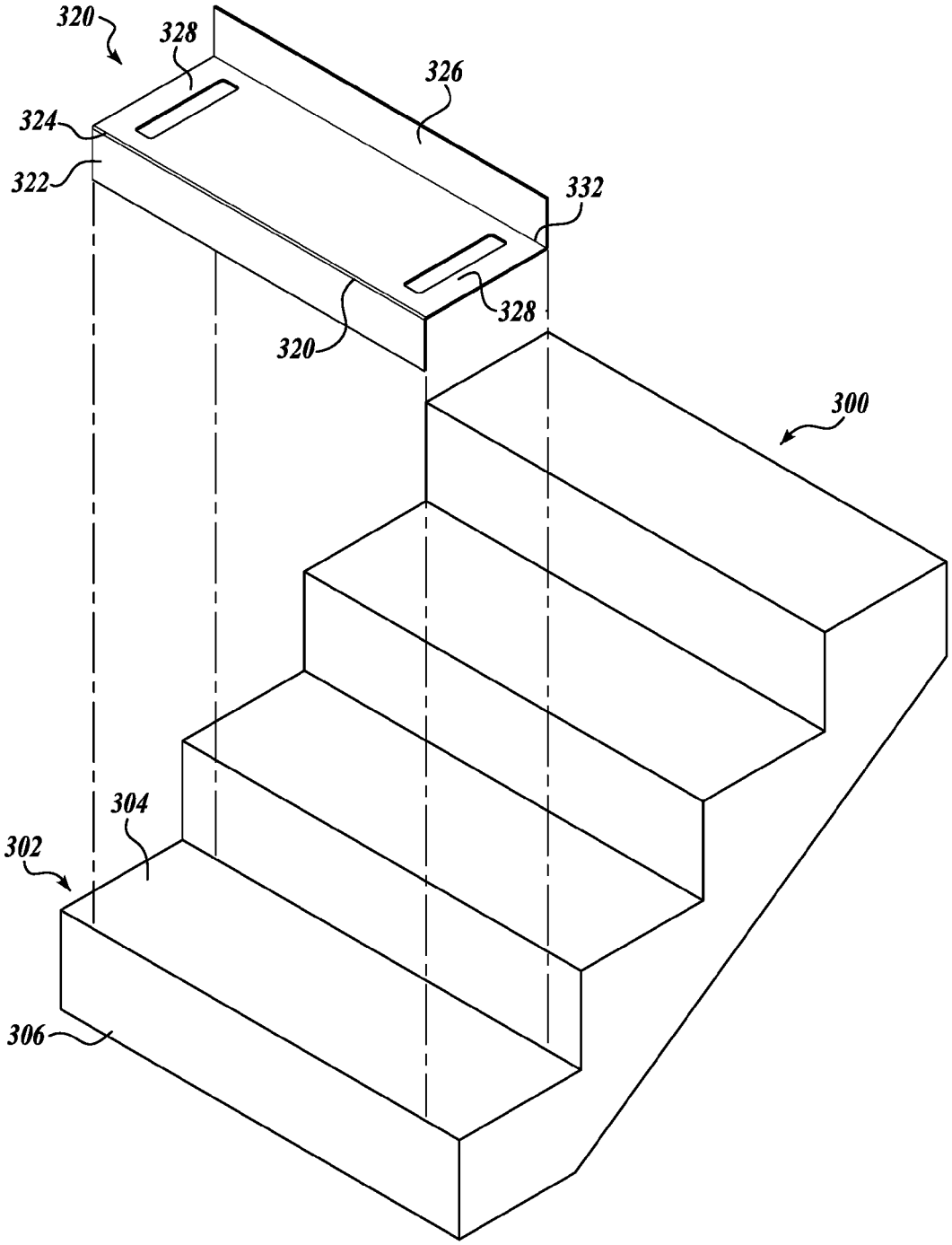

As shown in FIG. 3A, the stair protection device 320 may initially be provided in a flat configuration. This flat configuration allows multiple stair protection devices to be stacked flat when sold and/or transported to the project. For example, multiple stair protection devices can be stacked flat and packaged together, such as in plastic shrink wrap, to remain flat until installed on a staircase. Selling and/or transporting the stair protection devices flat eliminates the issue with cardboard sheeting having a curvature from being sold and/or transported on round rolls. Returning to the stair protection device 320 shown in FIG. 3A, a user can bend the stair protection device 320 into a desired position. For example, the user can bend the stair protection device 320 along each of the first and second scores 330 and 332 such that the first riser protection portion 322 is bent downward and the second riser protection portion 324 is bent upward to achieve the position of the stair protection device 320 depicted in FIG. 3B.

Figure 3C:
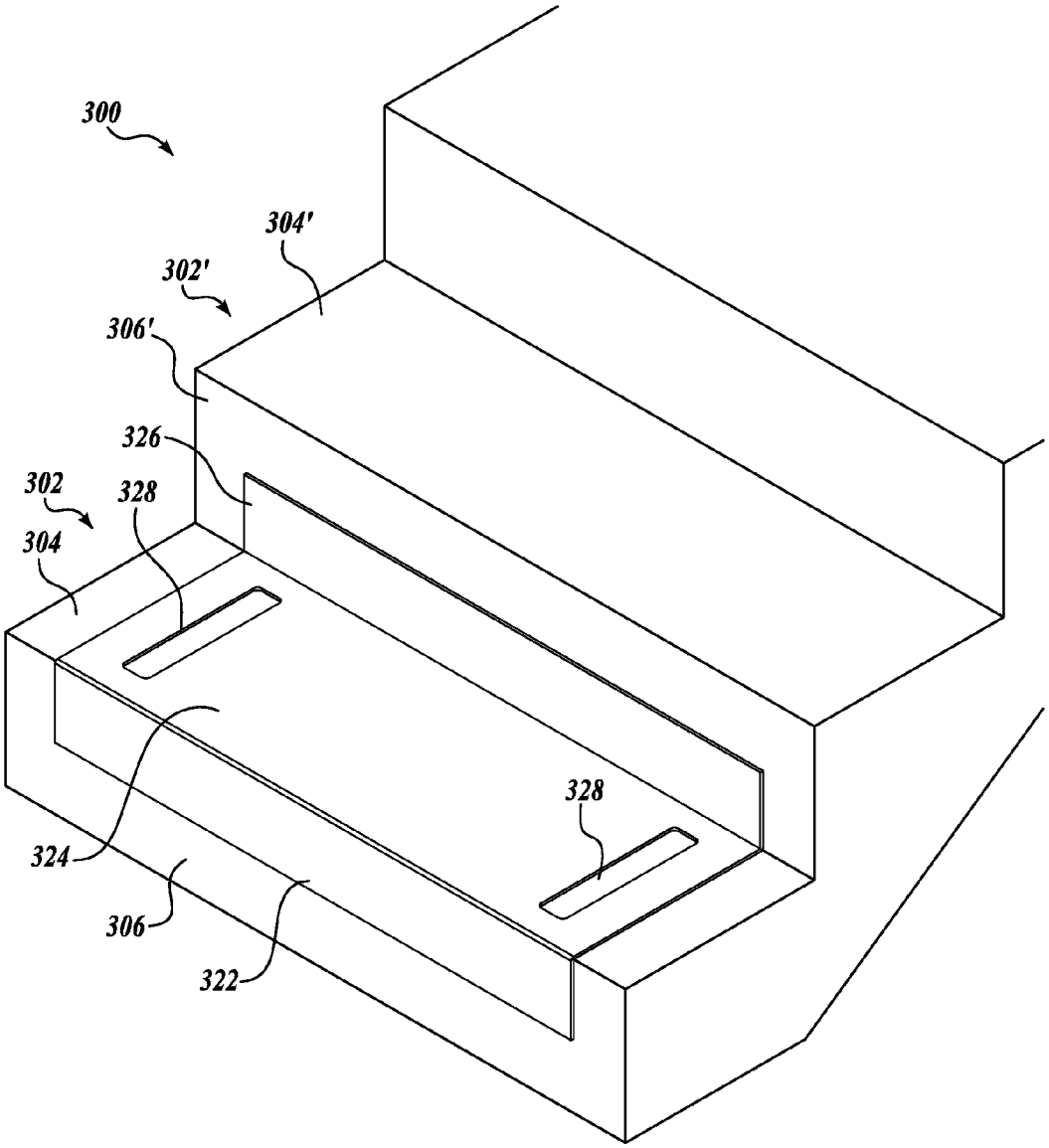

Once the stair protection device 320 is bent into a desired position, the stair protection device 320 can be placed into a desired position onto the staircase 300, such as the position shown in FIG. 3C. As depicted in FIG. 3C, the stair protection device 320 is placed on the stair 302 with the tread protection portion 324 on the tread 304 of the stair 302, the first riser protection portion 322 on the riser 306 of the stair 302, and the second riser protection portion 326 on the riser 306' of the subsequent stair 302'. As can be seen in FIG. 3C, the first riser protection portion 322, the tread protection portion 324, and the second riser protection portion 326 may not cover the entirety of the riser 306, the tread 304, and the riser 306', respectively.

Figure 3D:
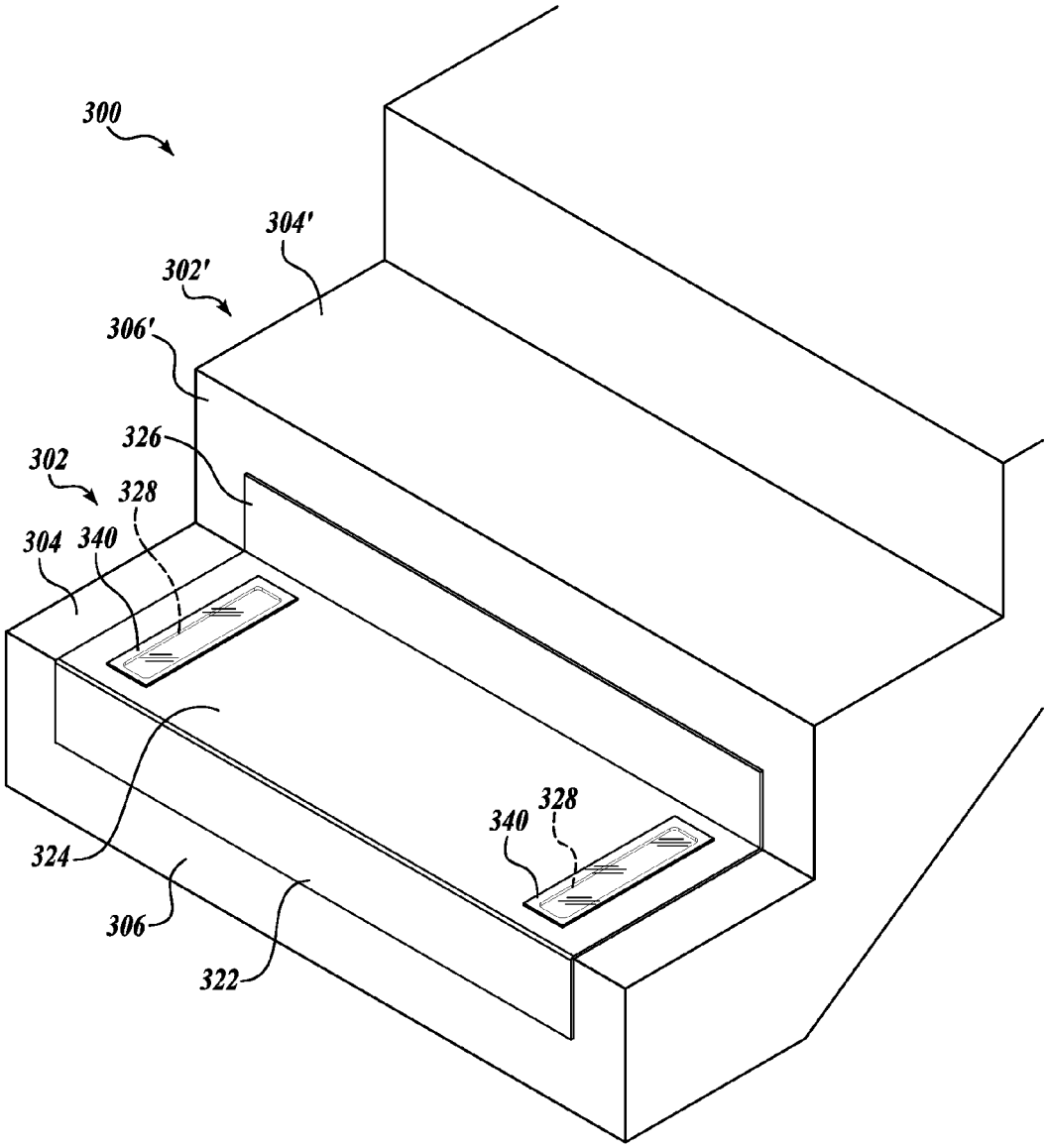
Figure 3E:
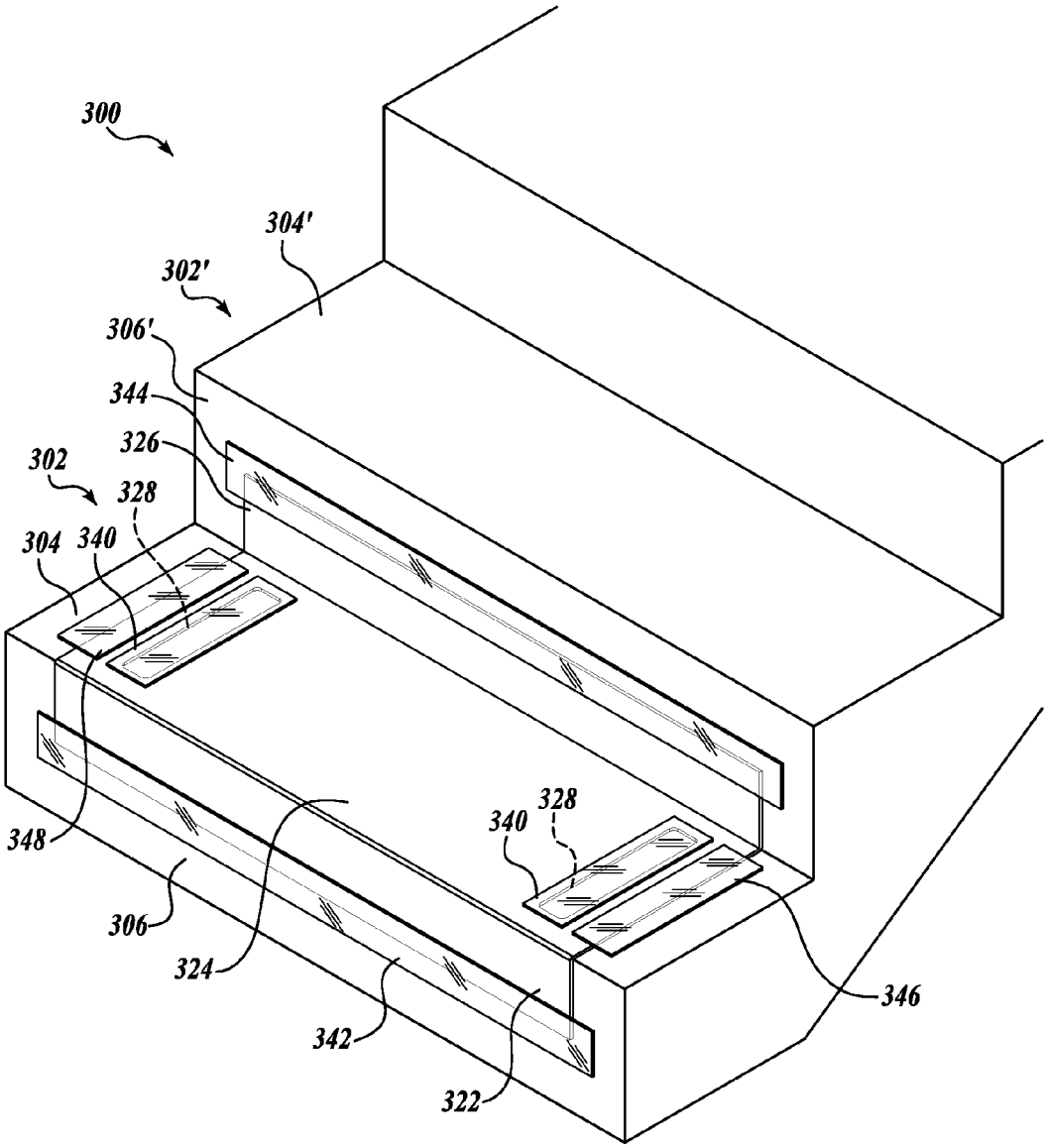

After the stair protection device 320 is placed into a desired position onto the staircase 300, the installation of the stair protection device 320 can be completed by adhering tape 340 to the top of the tread protection portion 324, as shown in FIG. 3D. The tape 340 is adhered to the top of the tread protection portion 324 over the at least one slit 328 such that at least a portion of the tape 340 passes through the at least one slit 328 and adheres to the tread 304 of the stair 302. The tape 340 holds the stair protection device 320 to the stair 302 and protects the portion of the tread 304 that is underneath the at least one slit 328. Although the tape 340 may securely hold the stair protection device 320 to the stair 302, other portions of the stair protection device 320 may be adhered to the staircase 300 to increase safety. For example, as shown in FIG. 3E, tape 342 may be used to adhere the first riser protection portion 322 to the riser 306, tape 344 may be used to adhere the second riser protection portion 326 to the riser 306', and tape 346 and 348 may be used to adhere sides of the tread protection portion 324 to the tread 304. In some embodiments, the tape 340, 342, 344, 346, and 348 are configured to remain adhered to the staircase 300 for a time and then be removed with minimal or no adhesive reside left on the staircase 300. For example, tape 340, 342, 344, 346, and 348 may be painter's tape or masking tape.

Figure 3F:
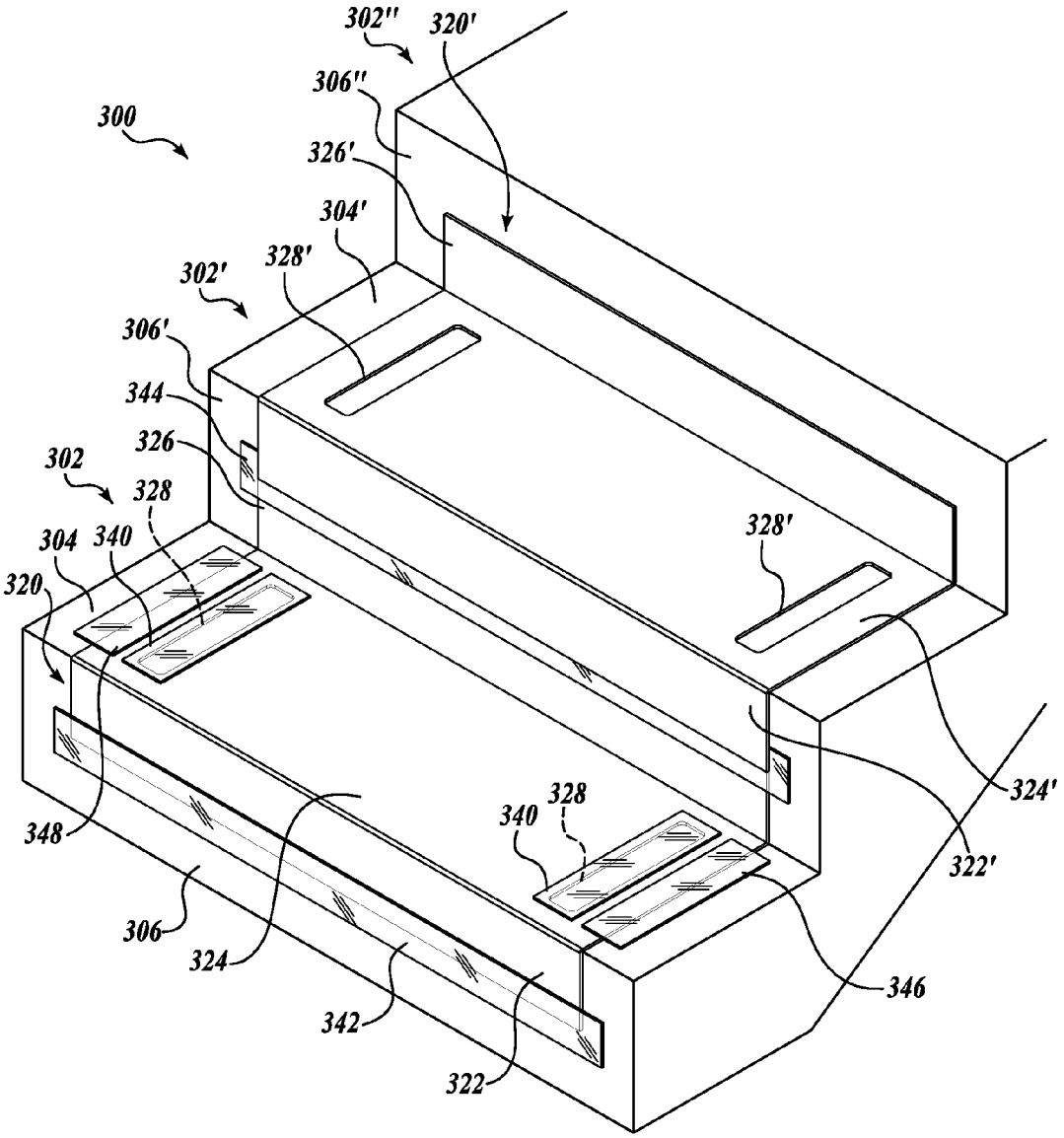
Figure 3G:
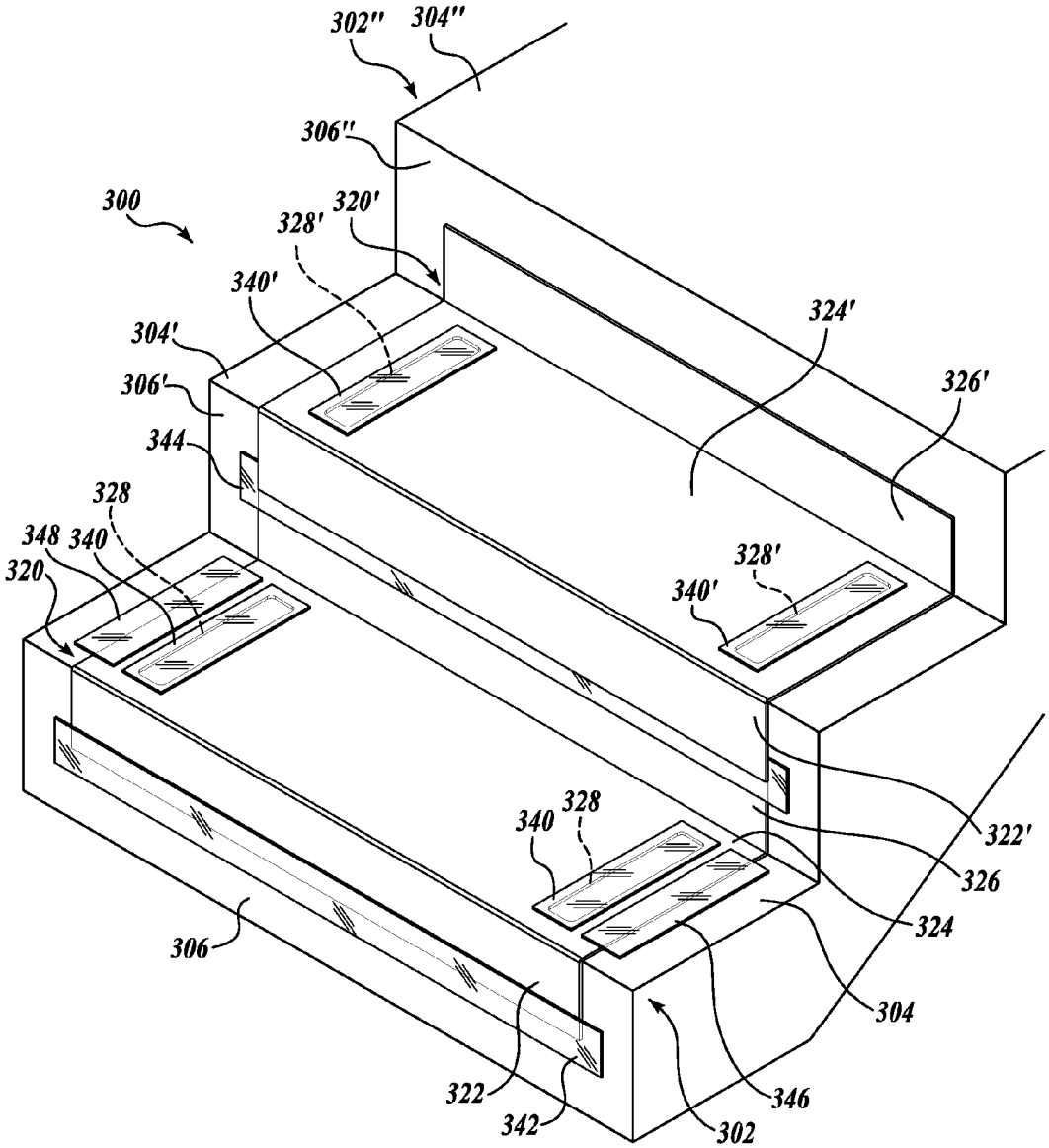
Figure 3H:
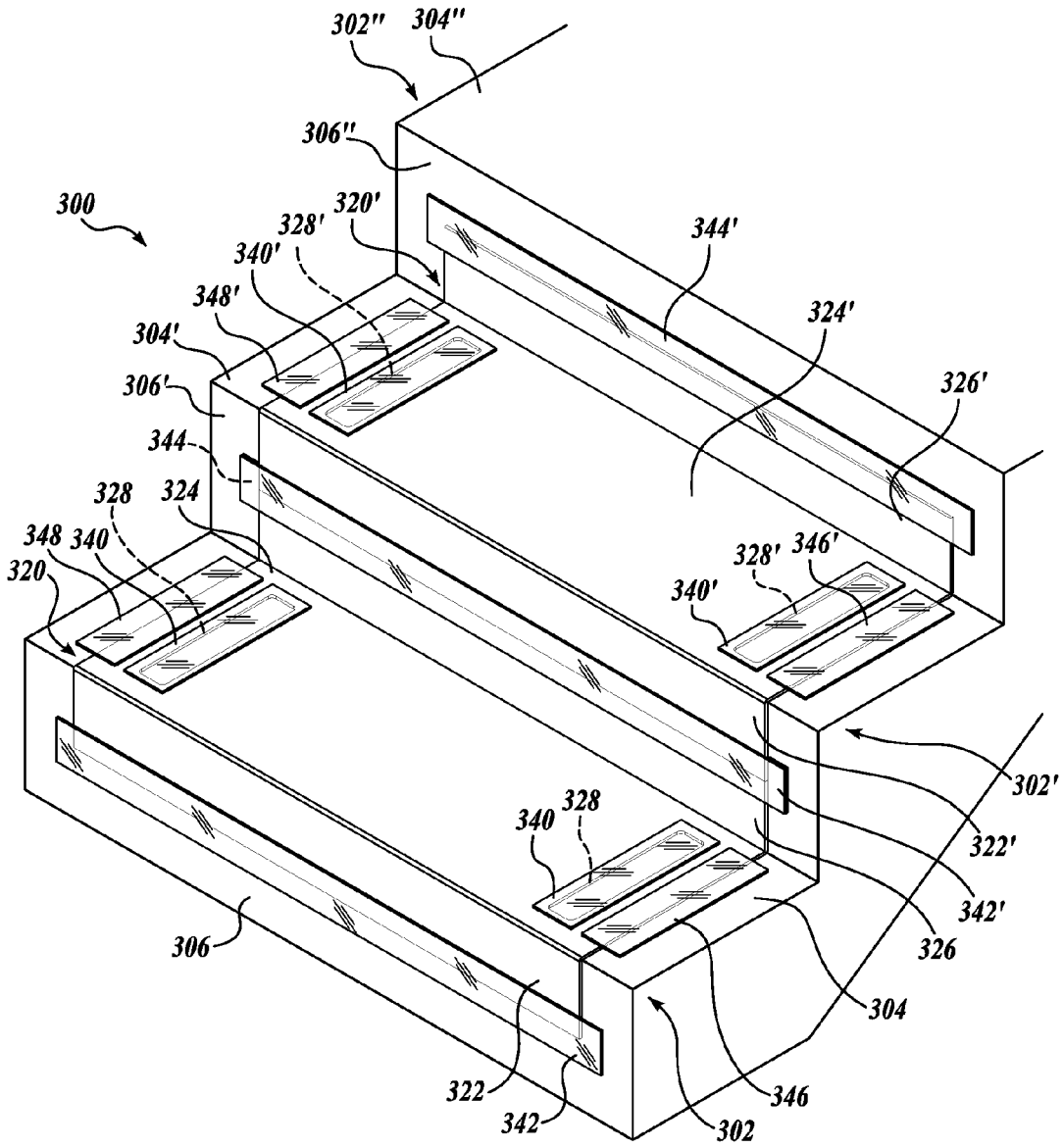

As depicted in FIGS. 3F to 3H, the stair protection device 320' can be installed on the staircase 300 after the stair protection device 320 has been installed. In FIG. 3F, the stair protection device 320' is placed on the staircase 300 with the tread protection portion 324' on the tread 304' of the stair 302', the first riser protection portion 322' on the riser 306' of the stair 302' and the second riser protection portion 326 of the stair protection device 320, and the second riser protection portion 326' on the riser 306" of the subsequent stair 302". In FIG. 3G, tape 340' is adhered to the top of the tread protection portion 324' over the at least one slit 328' such that at least a portion of the tape 340' passes through the at least one slit 328' and adheres to the tread 304' of the stair 302'. The tape 340' holds the stair protection device 320' to the stair 302' and protects the portion of the tread 304' that is underneath the at least one slit 328'.

Although the tape 340' may securely hold the stair protection device 320' to the stair 302', other portions of the stair protection device 320 may be adhered to the staircase 300 to increase safety. For example, as shown in FIG. 3H, tape 342' may be used to adhere the first riser protection portion 322' to the riser 306' and/or the second riser protection portion 326, tape 344' may be used to adhere the second riser protection portion 326' to the riser 306", and tape 346' and 348' may be used to adhere sides of the tread protection portion 324' to the tread 304'.

The process depicted in FIGS. 3F to 3H may be repeated to install other stair protection devices on the other stairs of the staircase 300. This process of installing stair protection devices on the stairs of the staircase 300 may save time over the former process of bending a single cardboard sheet to fit the stairs of the staircase 300. When stair protection devices are installed on all of the stairs of the staircase 300, the stairs will be protected from workers, tools, and other potential dangers, and the stair protection devices will be secure to the stairs in a way that poses less of a tripping risk than the former stair protection methods.

Figure 4A:
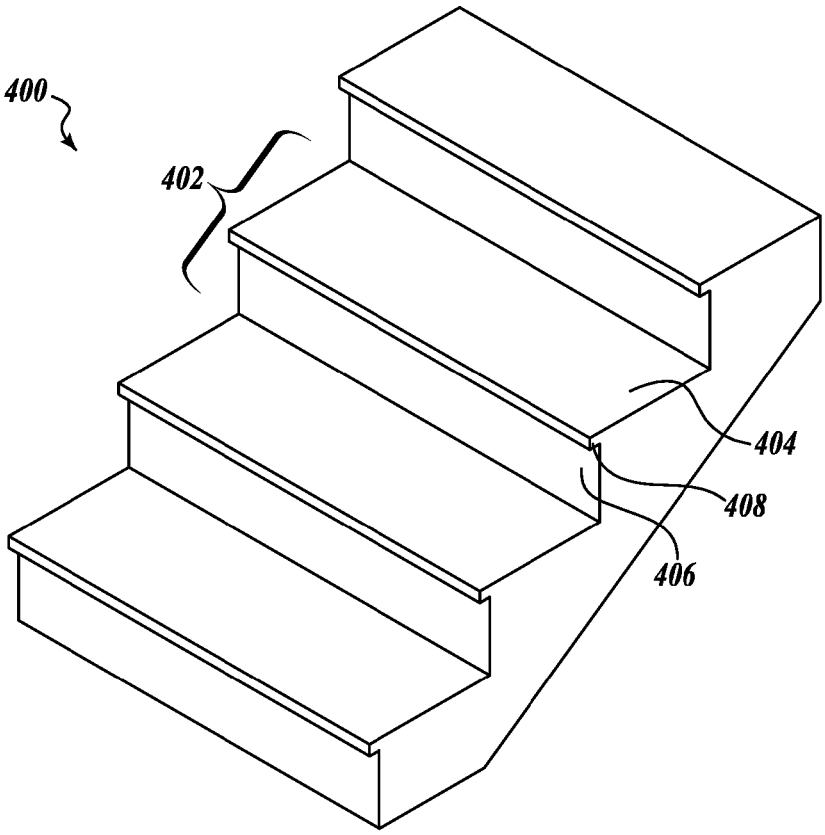
FIGS. 4A and 4B depict an example of a staircase that has stairs with nosings.
Figure 4B:
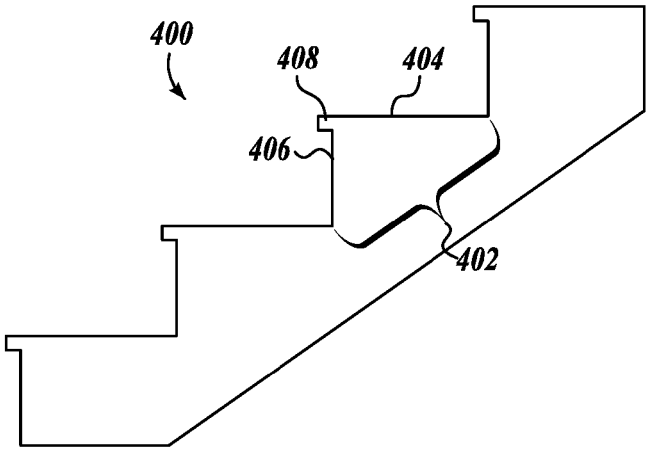

FIGS. 4A and 4B depict an example of a staircase 400 that has stairs with nosings. The staircase 400 has a number of stairs, including stair 402. The stair 402 includes a tread 404 and a riser 406. The tread 404 of the stair 402 has a nosing 408 that extends beyond the riser 406 of the stair 402. Because the nosing 408 that extends beyond the riser 406 of the stair 402, the stair protection devices 220 and 320 would be difficult to use on stair 402 and have the first riser protection portions 222 and 322 taped against the riser 406.

Figure 5A:
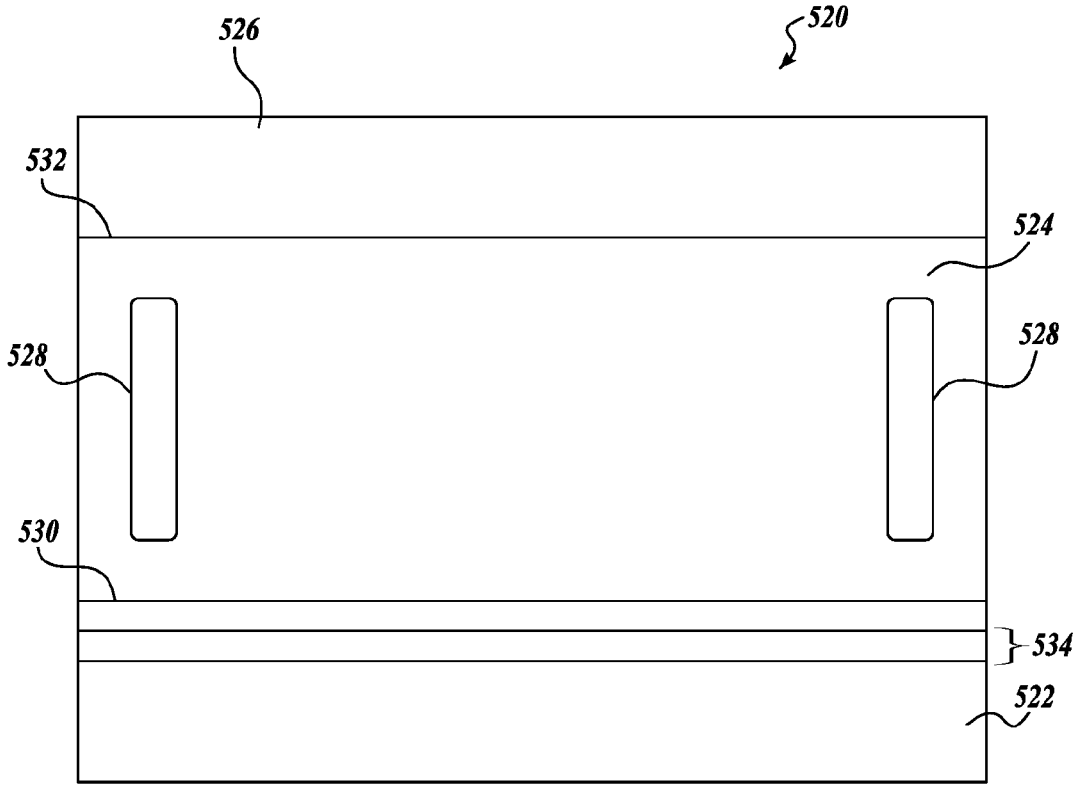
FIGS. 5A and 5B depict, respectively, a top view of an embodiment of a stair protection device in an unfolded state and a side view of the stair protection device in a folded state.
Figure 5B:
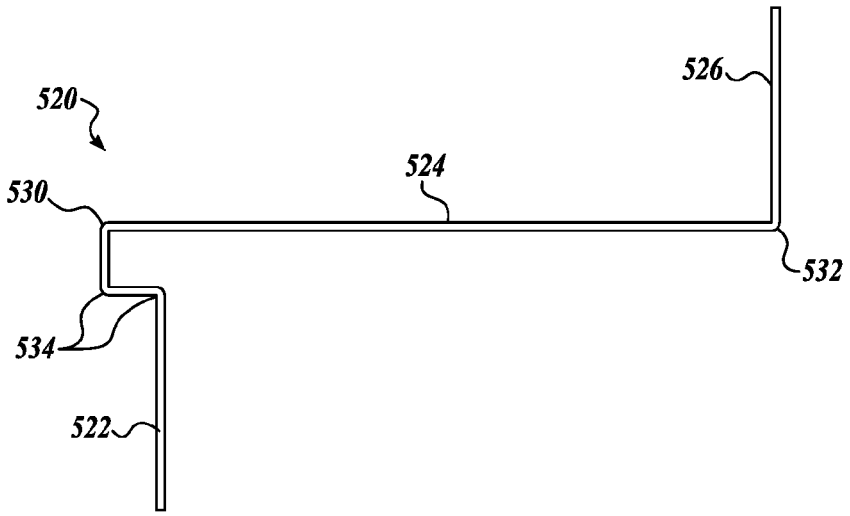

FIGS. 5A and 5B depict, respectively, a top view of an embodiment of a stair protection device 520 in an unfolded state and a side view of the stair protection device 520 in a folded state. The stair protection device 520 includes a first riser protection portion 522, a tread protection portion 524, and a second riser protection portion 526. The tread protection portion 524 includes at least one slit 528. The stair protection device 520 also includes a first score 530 located between the first riser protection portion 522 and the tread protection portion 524 and a second score 532 located between the second riser protection portion 526 and the tread protection portion 524.

The stair protection device 520 also includes a plurality of scores 534 located on the first riser protection portion 522. In the particular embodiment shown in FIGS. 5A and 5B, the plurality of scores 534 includes two scores; however, more than two scores could be included. As shown in FIG. 5B, the plurality of scores 534 can be bent to form a profile that will accommodate a nosing of a stair. More specifically, when the stair protection device 520 is in the folded state depicted in FIG. 5B, the stair protection device 520 can be placed on a stair with the tread protection portion 524 on the tread of the stair, the first riser protection portion 522 bending around the nosing of the stair and reaching the riser of the stair, and the second riser protection portion 526 on a riser of a subsequent stair.

Figure 6A:
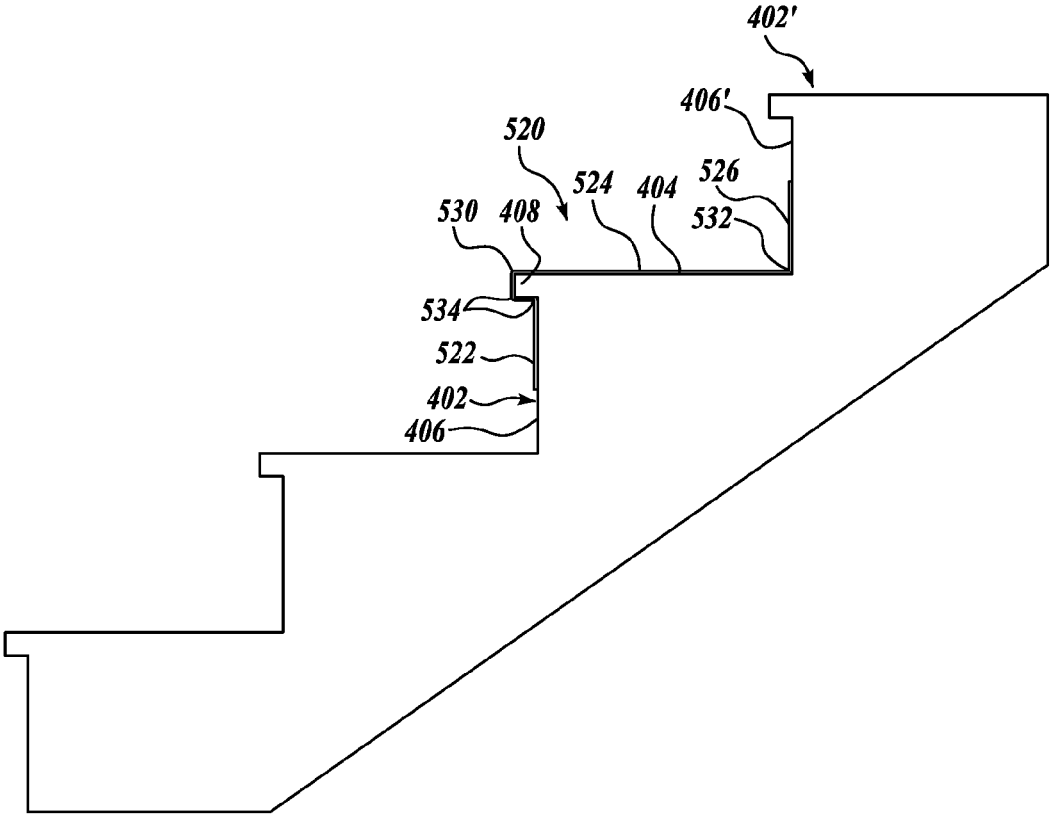
FIGS. 6A and 6B depict side and perspective views, respectively, of the stair protection device depicted in FIGS. 5A and 5B placed on the stair of the staircase depicted in FIGS. 4A and 4B.
Figure 6B:
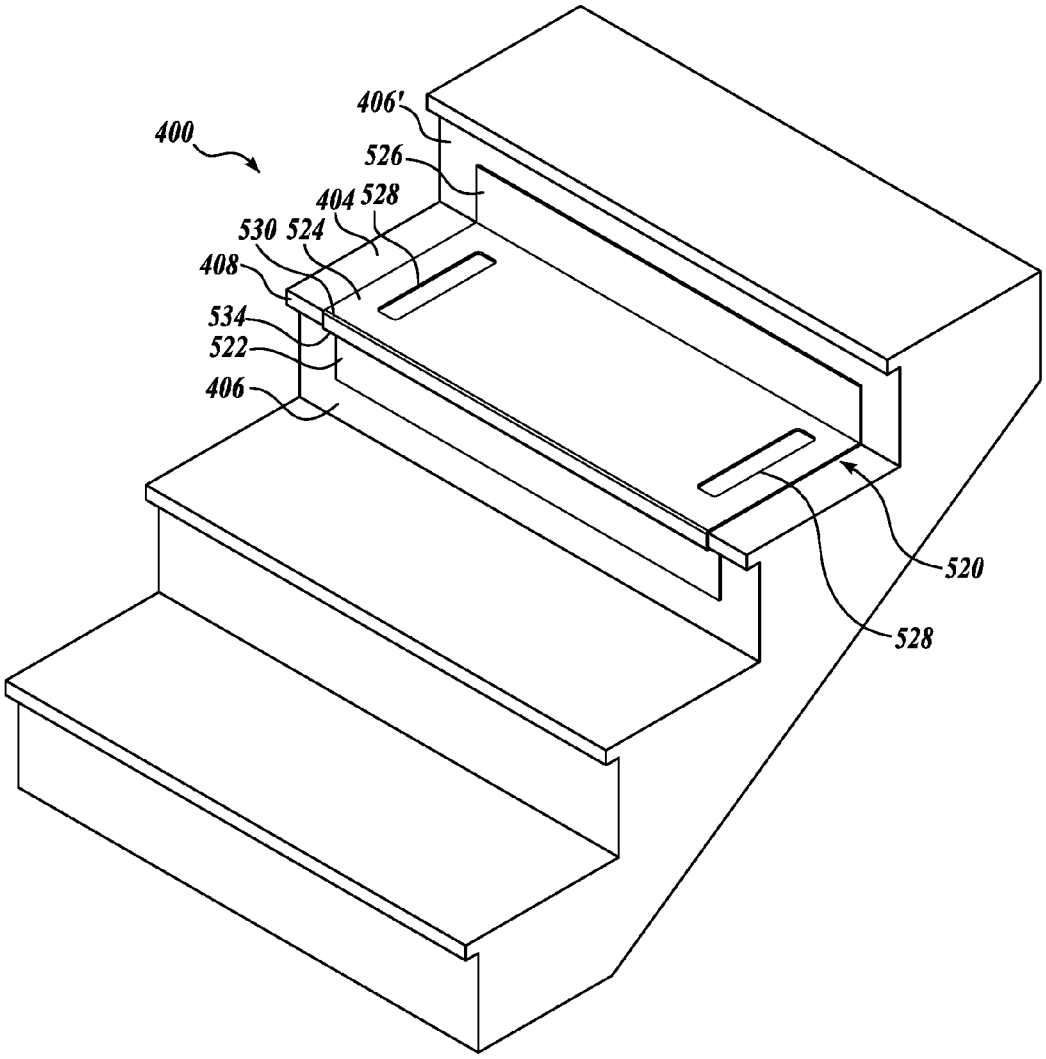

FIGS. 6A and 6B depict side and perspective views, respectively, of the stair protection device 520 placed on the stair 402 of staircase 400. In the illustrated embodiment, the stair protection device 520 is placed on the stair 402 with the tread protection portion 524 on the tread 404 of the stair 402, the first riser protection portion 522 bending around the nosing 408 of the stair 402 and reaching the riser 406 of the stair 402, and the second riser protection portion 526 on a riser 406' of a subsequent stair 402'. At the point illustrated in FIGS. 6A and 6B, the stair protection device 520 can be secured to the stair 402 by adhering tape to the top of the stair protection device 520 over the at least one slit 528 such that at least a portion of the tape passes through the at least one slit 528 and adheres to the tread 404 of the stair 402. Tape can also be used to secure other portions of the stair protection device 520 to the staircase 400, such as by taping the first riser protection portion 522 to the riser 406 and/or the second riser protection portion 526 to the riser 406'.

As noted above, the plurality of scores 534 may include more than two scores. Having more than two scores may accommodate a variety of sizes of treads, nosings, and/or risers. Having a single stair protection device that can accommodate a variety of sizes of treads, nosings, and/or risers increases number of situations in which the stair protection device can be used and the speed with which the stair protection device can be installed on stairs. Moreover, the stair protection device 520 with the plurality of scores 534 can still be used on stairs that do not have nosings, such as the staircase 100 depicted in FIGS. 1A and 1B. In that case, a user may simply not bend the stair protection device 520 at any of the plurality of scores 534 when installing the stair protection device 520 on the stairs that do not have nosings.

Figure 7A:
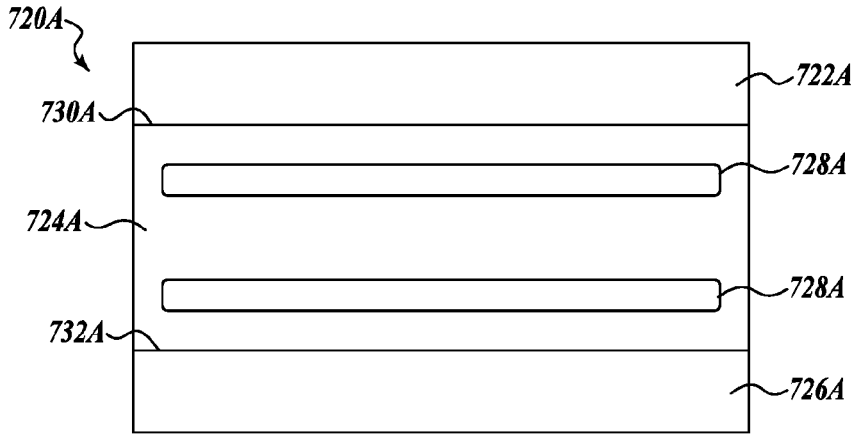
FIGS. 7A to 7C depict top view of various embodiments of stair protection devices, an accordance with other embodiments of stair protection devices described herein.
Figure 7B:
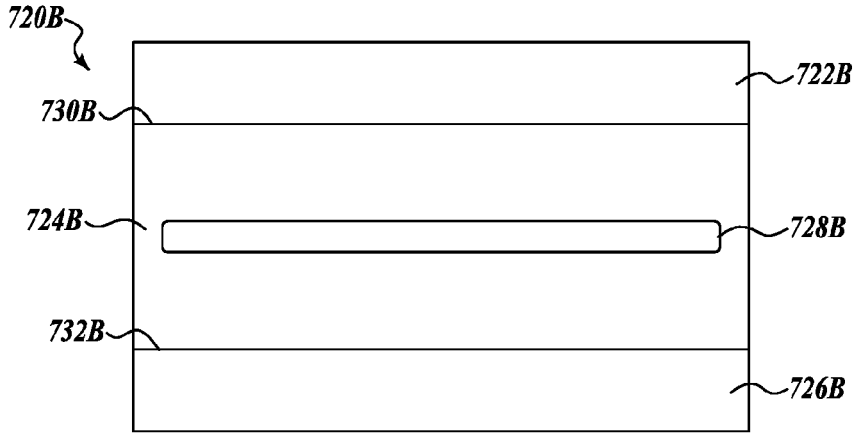
Figure 7C:
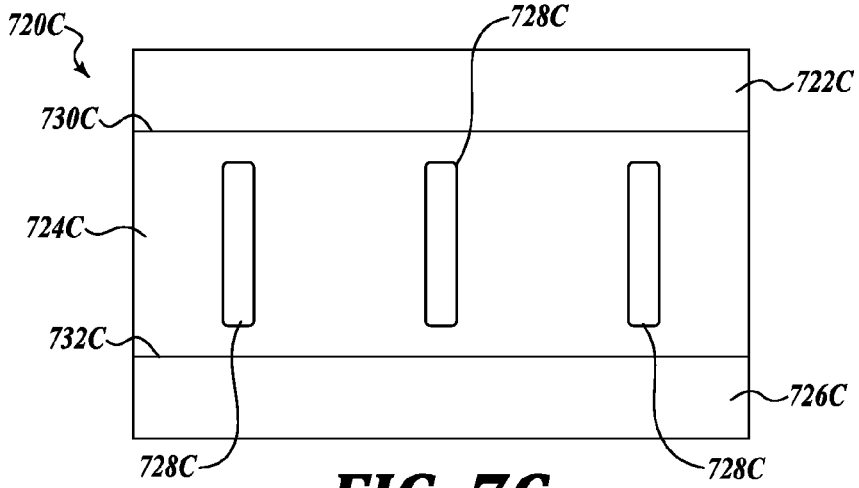

FIGS. 7A to 7C depict top view of various embodiments of stair protection devices 720A-C. The stair protection devices 720A-C include first riser protection portions 722A-C, tread protection portion 724A-C, and second riser protection portions 726A-C. The tread protection portions 724A-C include one or more slits 728A-C. The stair protection devices 720A-C also include first scores 730A-C located between the respective first riser protection portions 722A-C and tread protection portions 724A-C and second scores 732A-C located between the respective second riser protection portions 726A-C and tread protection portions 724A-C.

The stair protection devices 720A-C include different embodiments of the one or more slits 728A-C. The one or more slits 728A of stair protection device 720A include two slits that have widths that are greater than their lengths. The one or more slits 728B of stair protection device 720B include a single slit that has a width that is greater than its length. The one or more slits 728C of stair protection device 720C include three slits that have lengths that are greater than their widths. In some embodiments, each of the one or more slits 728A-C has one dimension (e.g., one of a width or a length) that is about 8 inches and another dimension (e.g., the other of a width or a length) that is about 0.5 inches. Any other number, sizes, and arrangements of one or more slits may be used in accordance with the embodiments described herein.

Figure 8A:
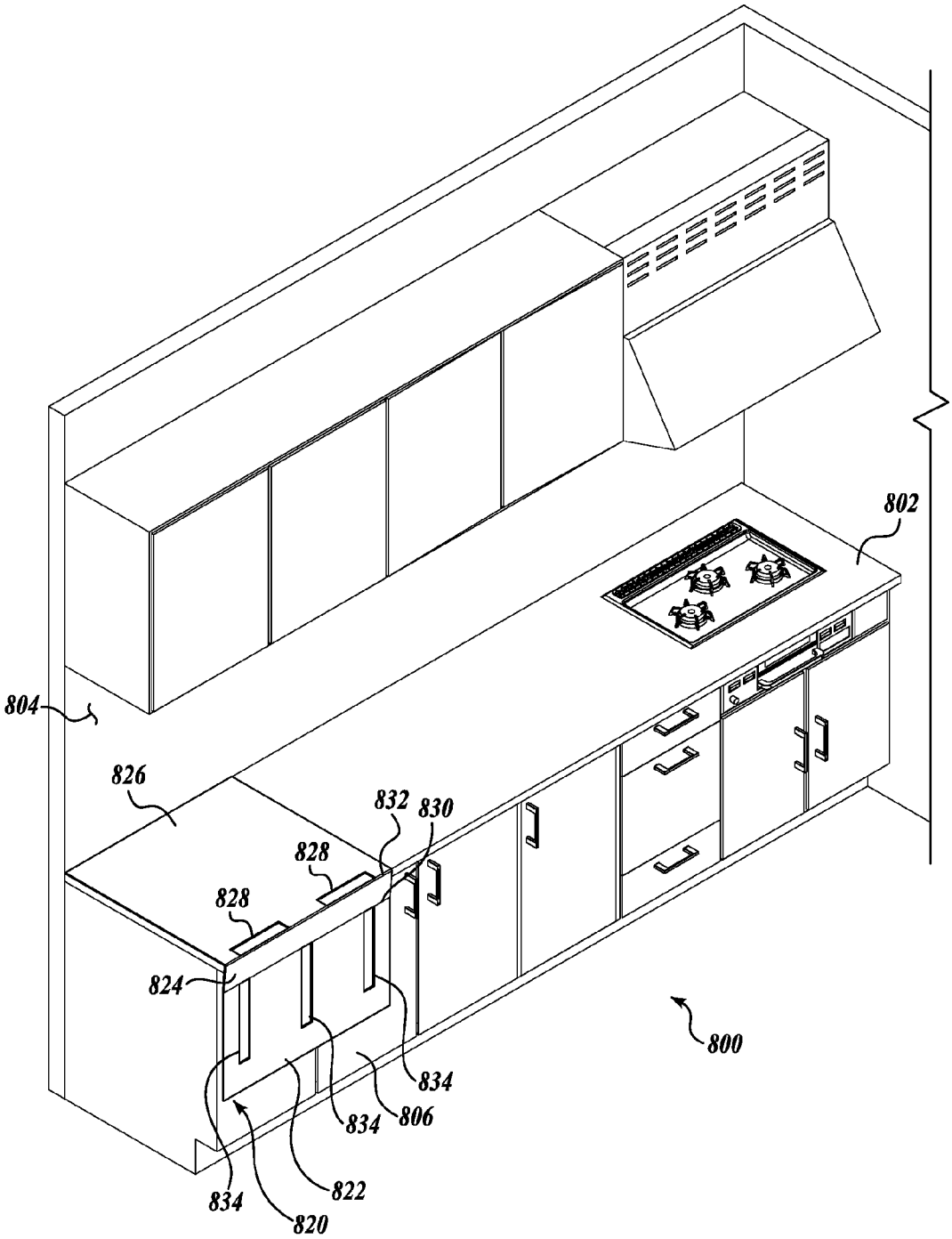
FIGS. 8A to 8C depict an embodiment of the use of an embodiment of a three-portion protection device to protect a surface with two adjacent surfaces.
Figure 8B:
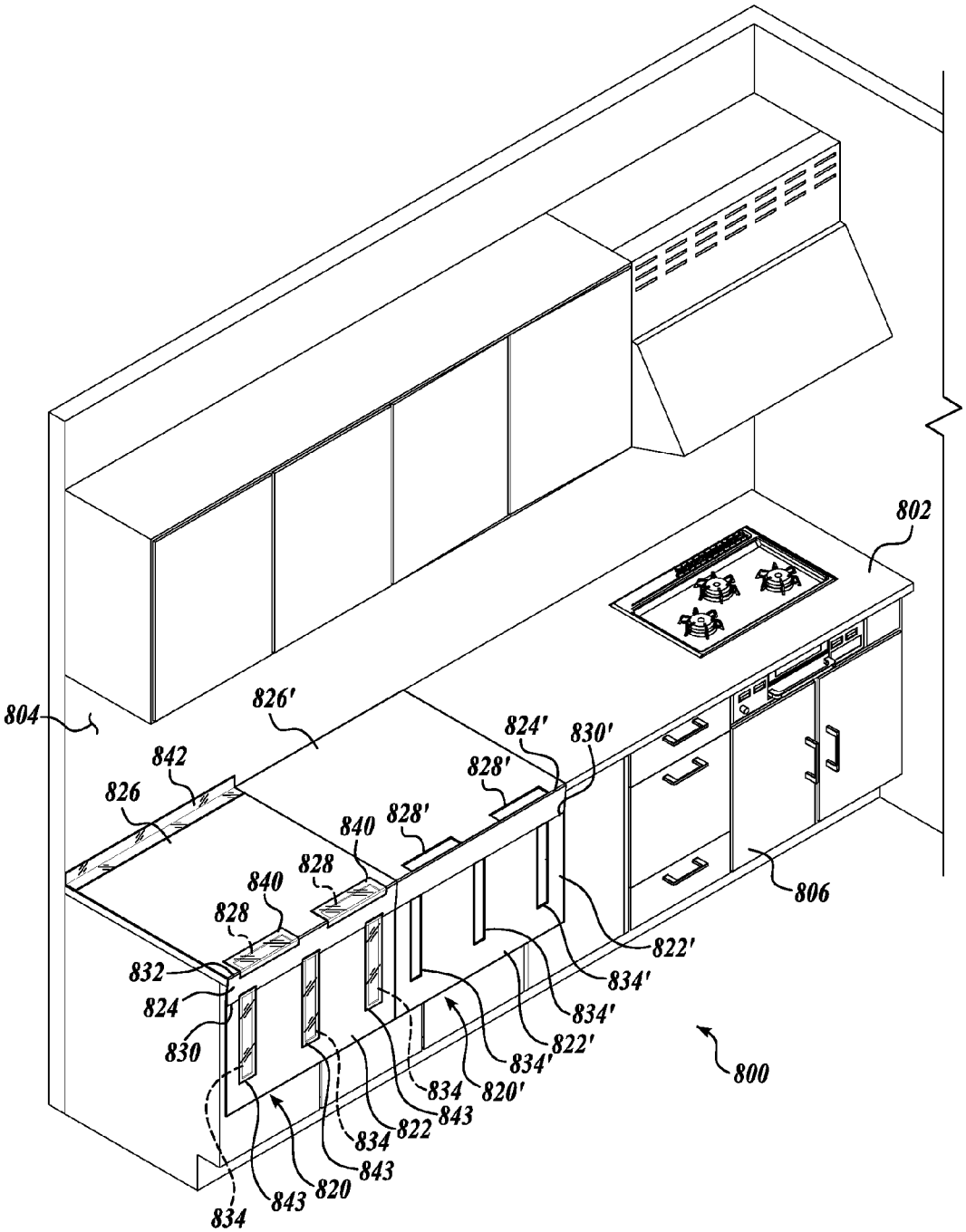
Figure 8C:
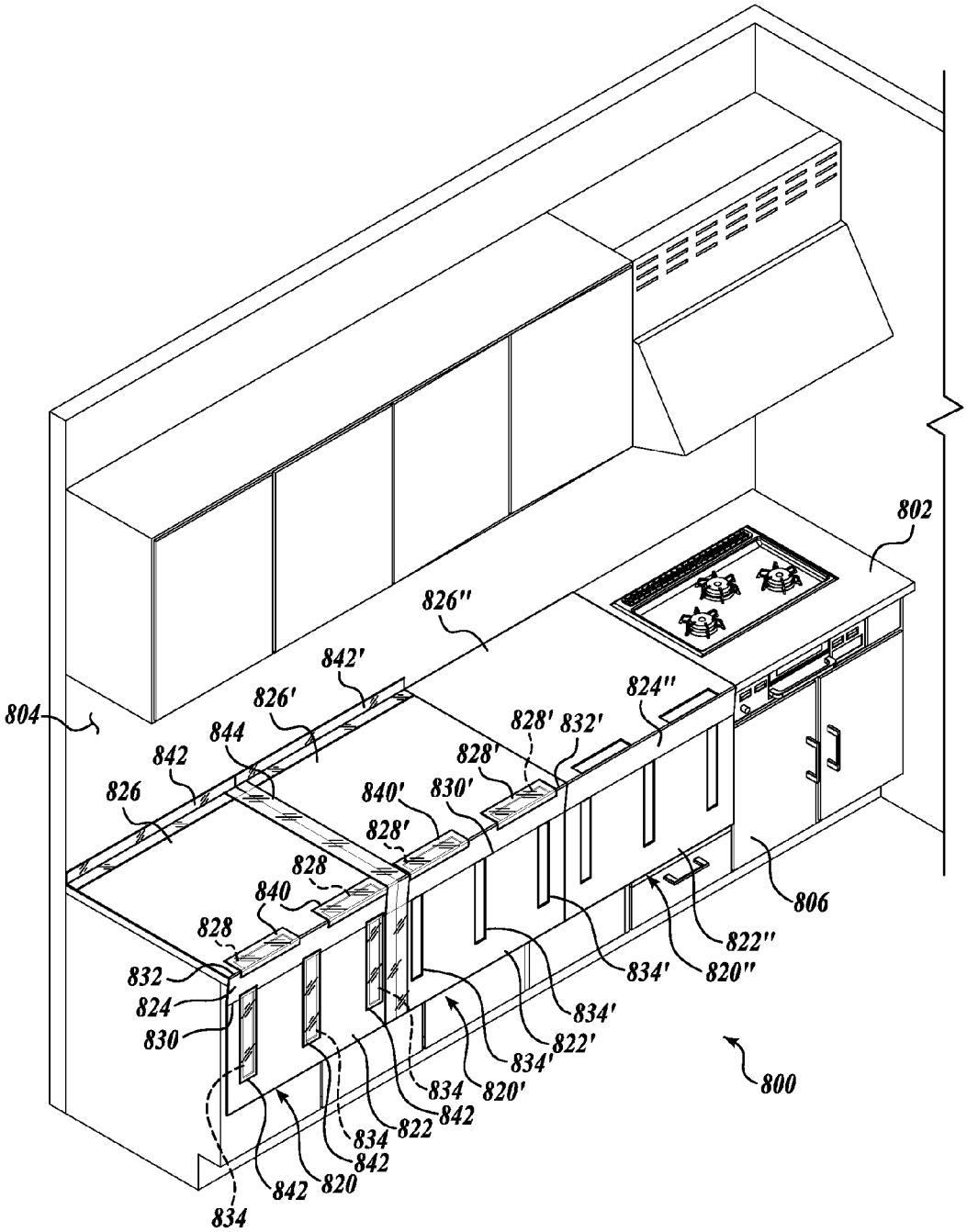

Variation of the stair protection devices described herein can be used to protect other surfaces that have multiple corners. For example, the use of an embodiment of a three-portion protection device 820 is depicted in FIGS. 8A-C to protect a surface with two adjacent surfaces in a kitchen 800. The kitchen 800 includes a countertop 802 (i.e., a surface), a wall 804 in back of the countertop 802 (i.e., an adjacent surface to the countertop 802), and cabinets 806 under the countertop 802 (i.e., an adjacent surface to the countertop 802). The countertop 802 can be made from any number of materials, such as tile, stone (e.g., granite), solid surfaces (e.g., CORIAN), and the like. A portion of the wall 804 can include a back splash made from the same material as the countertop 802. It may be desirable to protect some or all of the countertop 802, the wall 804, and the cabinets 806.

The protection device 820 includes a first portion 822, a second portion 824, and a third portion 826. The third portion 826 includes one or more slits 828. The protection device 820 also includes a first score 830 located between the first portion 822 and the second portion 824 and a second score 832 located between the second portion 824 and the third portion 826. The first and second scores 830 and 832 may be made such that a user can bend the protection device 820 from an unfolded state to the folded state depicted in FIG. 8A.

As shown in FIG. 8A, the protection device 820 can be placed with the third portion 826 on the countertop 802, the first portion 822 covering a portion of the cabinets 806, and the second portion 824 providing a transition between the countertop 802 and the cabinets 806. The one or more slits 828 in the third portion 826 are located over the countertop 802. At that point, the protection device 820 can be secured to the countertop 802 by adhering tape to the top of the third portion 826 over the at least one slit 828 such that at least a portion of the tape passes through the at least one slit 828 and adheres to the countertop 802. As shown in FIG. 8B, tape 840 is adhered to the top of the third portion 826 over the at least one slit 828. The tape 840 secures the protection device 820 to the countertop 802. Other portions of the protection device 820 can also be secured with tape. For example, tape 842 can be used to secure the third portion 826 to the wall 804.

The first and second scores 830 and 832 permit the first and second portions 822 and 824 to be folded up to permit access to the cabinets 806 when needed. The first portion 822 can also include one or more slits 834. As shown in FIG. 8B, the first portion 822 can be secured to the cabinets 806 by adhering tape 843 to the top of the first portion 822 over the at least one slit 834 such that at least a portion of the tape 843 passes through the at least one slit 834 and adheres to the cabinets 806.

The protection device 820 alone may not cover the entire countertop 802. As shown in FIG. 8B, another protection device 820' can be placed next to the protection device 820 on the countertop 802. The protection device 820' includes a first portion 822', a second portion 824', and a third portion 826'. The third portion 826' includes one or more slits 828'. The protection device 820' also includes a first score 830' located between the first portion 822' and the second portion 824' and a second score 832' located between the second portion 824' and the third portion 826'. The first and second scores 830' and 832' may be made such that a user can bend the protection device 820' from an unfolded state to the folded state depicted in FIG. 8B.

As shown in FIG. 8B, the protection device 820' can be placed with the third portion 826' on the countertop 802, the first portion 822' covering a portion of the cabinets 806, and the second portion 824' providing a transition between the countertop 802 and the cabinets 806. The one or more slits 828' in the third portion 826' are located over the countertop 802. At that point, the protection device 820' can be secured to the countertop 802 by adhering tape to the top of the third portion 826' over the at least one slit 828' such that at least a portion of the tape passes through the at least one slit 828' and adheres to the countertop 802. As shown in FIG. 8C, tape 840' is adhered to the top of the third portion 826' over the at least one slit 828'. The tape 840' secures the protection device 820' to the countertop 802. Other portions of the protection device 820' can also be secured with tape. For example, tape 842' can be used to secure the third portion 826' to the wall 804. In another example, tape 844 can secure the protection device 820 to the protection device 820'.

If the protection device 820 and the protection device 820' do not cover all of the countertop 802, then, as shown in FIG. 8C, another protection device 820" can be placed on the countertop 802. The protection device 820" can be secured in similar fashion to the securing of the protection device 820 and the protection device 820' descried above. This process of securing protection devices can continue until all of the countertop 802 is covered.

While embodiments of the subject matter disclosed herein have been illustrated and described, it will be appreciated that various changes can be made therein without departing from the spirit and scope of the claimed subject matter.

The detailed description set forth herein in connection with the drawings is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The embodiment of the disclosure in which an exclusive property of privilege is claimed are defined as follows:

1. A stair protection device comprising:

a protection sheet having a first riser protection portion, a tread protection portion, and a second riser protection portion;

at least one slit in the tread protection portion;

a first score in the protection sheet between the first riser protection portion and the tread protection portion; and a second score in the protection sheet between the second riser protection portion and the tread protection portion;

wherein the protection sheet is configured to be secured on a stair with the tread protection portion on a tread of the stair, the first riser protection portion on a riser of the stair, and the second riser protection portion on a riser of a subsequent stair, by adhering tape on a top of the tread protection portion over the at least one slit such that at least a portion of the tape passes through the at least one slit and adheres to the tread of the stair.

2. The stair protection device of claim 1, wherein the first riser section comprises a plurality of scores.

3. The stair protection device of claim 2, wherein the plurality of scores are configured to be bent around a nosing of the stair such that a portion of the first riser protection portion reaches the riser of the stair.

4. The stair protection device of claim 1, wherein the at least one slit comprises two slits, and wherein a first dimension of each of the two slits is greater than a second dimension of each of the two slits.

5. The stair protection device of claim 1, wherein the at least one slit comprises one slit, and wherein a first dimension of the one slit is greater than a second dimension of the one slit.

6. A method of protecting a stair, the method comprising:

bending a protection sheet from an unfolded state to a folded state, wherein bending the protection sheet comprises bending the protection sheet at a first score of the protection sheet between a first riser protection portion of the protection sheet and a tread protection portion of the protection sheet, and bending the protection sheet at a second score between a second riser protection portion of the protection sheet and the tread protection portion of the protection sheet;

placing the protection sheet on a stair with the tread protection portion on a tread of the stair, the first riser protection portion on a riser of the stair, and the second riser protection portion on a riser of a subsequent stair; and securing the protection sheet to the stair by adhering tape on a top of the tread protection portion over at least one slit in the tread protection portion such that at least a portion of the tape passes through the at least one slit and adheres to the tread of the stair.

7. The method of claim 6, further comprising:

taping sides of the tread protection portion to the tread of the stair.

8. The method of claim 6, further comprising:

taping the first riser protection portion to one or more of the riser of the stair or a second riser protection portion of a second protection sheet.

9. The method of claim 6, further comprising:

taping the second riser protection portion to one or more of the riser of the subsequent stair or a first riser protection portion of a second protection sheet.

10. The method of claim 6, further comprising:

bending a plurality of scores in the first riser section; and placing a portion of the first riser section that includes at least some of the plurality of scores around a nosing of the stair.

11. A method of protecting a surface having multiple corners, the method comprising:

bending a protection sheet from an unfolded state to a folded state, wherein bending the protection sheet comprises bending the protection sheet at a first score of the protection sheet between a first portion of the protection sheet and a second portion of the protection sheet, and bending the protection sheet at a second score between the second portion of the protection sheet and a third portion of the protection sheet;

placing the protection sheet on a first surface with the first portion on the first surface and the third portion over a portion of a second surface; and securing the protection sheet to the surface by adhering tape on a top of the first portion over at least one slit in the first portion such that at least a portion of the tape passes through the at least one slit and adheres to the first surface.

12. The method of claim 11, wherein the first surface comprises a countertop, wherein the second surface comprises at least one cabinet.

13. The method of claim 11, further comprising:

securing the protection sheet to another protection sheet that has been secured to the first surface.

* * * * *